US007703263B2

(12) United States Patent
Reiner

(10) Patent No.: US 7,703,263 B2
(45) Date of Patent: Apr. 27, 2010

(54) METHOD AND DEVICE FOR SHRINKING A HEAT SHRINK FILM PLACED

(75) Inventor: Hannen Reiner, Kalkar-Wissel (DE)

(73) Assignee: MSK-Verpackungs-Systeme Gesellschaft mit beschrankter Haftung, Kleve (DE)

( * ) Notice: Subject to any disclaimer, the term of this patent is extended or adjusted under 35 U.S.C. 154(b) by 0 days.

(21) Appl. No.: 12/090,104

(22) PCT Filed: Oct. 23, 2006

(86) PCT No.: PCT/EP2006/010198

§ 371 (c)(1),
(2), (4) Date: Apr. 14, 2008

(87) PCT Pub. No.: WO2007/048558

PCT Pub. Date: May 3, 2007

(65) Prior Publication Data

US 2008/0202072 A1 Aug. 28, 2008

(30) Foreign Application Priority Data

Oct. 24, 2005 (DE) ..... 20 2005 016 725 U
Dec. 24, 2005 (DE) ..... 20 2005 020 192 U

(51) Int. Cl.
*B65B 53/02* (2006.01)

(52) U.S. Cl. ..... 53/442; 53/218; 53/557

(58) Field of Classification Search ..... 53/218, 53/441, 442, 556, 557
See application file for complete search history.

(56) References Cited

U.S. PATENT DOCUMENTS 3,621,588 A * 11/1971 Grocke ..... 53/557
3,662,512 A 5/1972 Zelnick ..... 53/30
3,667,598 A * 6/1972 Zelnick et al. ..... 53/557
3,807,126 A * 4/1974 Schwarz ..... 53/557
3,840,997 A * 10/1974 Lucas ..... 53/557
3,930,790 A * 1/1976 Rogosch ..... 53/557
4,651,508 A * 3/1987 Hannen ..... 53/557
4,866,916 A * 9/1989 Hannen et al. ..... 53/557

(Continued)

FOREIGN PATENT DOCUMENTS

EP 0595108 4/1997

(Continued)

*Primary Examiner*—Louis K Huynh
(74) *Attorney, Agent, or Firm*—Berenato & White, LLC

(57) ABSTRACT

A method using heat for shrinking a heat shrink film wrapping placed around a stack of items. The heat shrink film wrapping protrudes on the upper side of the stack of items at least beyond the upper edge of the stack of items to a top sheet film, which is welded to the heat shrink film wrapping. In the method hot gases rising up along the sides of the stack of items are diverted inward, in a direction parallel to the upper side of the stack of items, by a heat diverting and pressing apparatus, which is arranged above the stack of items. The heat diverting and pressing apparatus is for preheating and inwardly folding over the overhang of the heat shrink film wrapping and for preheating the top sheet film in the region of the upper side. The layers of the overhang are joined, by pressing the layers of the heat shrink film onto one another by the heat diverting and pressing apparatus. The invention also relates to an apparatus for carrying out the method.

7 Claims, 14 Drawing Sheets

U.S. PATENT DOCUMENTS

| | | | | |
|---|---|---|---|---|
| 5,502,947 | A * | 4/1996 | Birkenfeld et al. | 53/442 |
| 5,596,866 | A * | 1/1997 | Martin-Cocher et al. | 53/557 |
| 6,584,752 | B1 * | 7/2003 | Herava | 53/441 |
| 6,837,031 | B1 * | 1/2005 | Hannen et al. | 53/557 |

FOREIGN PATENT DOCUMENTS

| | | |
|---|---|---|
| EP | 1486420 | 6/2004 |

* cited by examiner

METHOD AND DEVICE FOR SHRINKING A HEAT SHRINK FILM PLACED

CROSS REFERENCE TO RELATED APPLICATIONS

This application is the US national phase of PCT application PCT/EP2006/010198, filed 23 Oct. 2006, published 3 May 2007 as WO 2007/048558, and claiming the priority of German patent application 202005016725.8 itself filed 24 Oct. 2005 and PCT patent application PCT/EP2006/010198 itself filed 23 Oct. 2006, whose entire disclosures are herewith incorporated by reference.

BACKGROUND OF THE INVENTION

The invention relates to a method for shrinking a heat shrink film wrapping placed around a stack of items, in particular a palleted stack of items, with at least one shrinking apparatus, which can be made to move in a vertical direction on a frame, is formed in particular as a shrink frame and is intended for shrinking the heat shrink film wrapping by heating, wherein the heat shrink film wrapping protrudes on the upper side at least beyond the upper edge of the stack of items for the upper shrink formation and arranged on the upper side of the stack of items is a top sheet film, which preferably protrudes beyond the edge of the stack of items and is welded to the heat shrink film wrapping.

SUMMARY OF THE INVENTION

Such methods are used, for example, in the papermaking industry. Here, pallets with formats of different dimensions that have to be packed on a shrink packing line are used. The shrinking takes place in this case after placing the top sheet film onto the upper side of the stack of items and subsequently providing the heat shrink film wrapping. The overhanging ends or edges of the top sheet film and a bottom film that is possibly additionally provided between the pallet and the stack of items are in this case clamped in between the heat shrink film wrapping and the stack of items or the pallet. To prevent ingress of moisture, adequate climatic protection must be ensured. This is only the case if adequate welding is ensured between the top sheet film placed on the stack of items and the heat shrink film wrapping formed as a sleeve.

The object of the invention is to provide a method by means of which the above-described disadvantages can be avoided and which ensures adequate climatic protection by improved welding of the top sheet film and the overhang of the heat shrink film wrapping.

This object is achieved by providing that, in a first step, the hot gases rising up along the sides of the stack of items are diverted inward, in a direction extending at least approximately parallel to the upper side of the stack of items, by a combined heat diverting and pressing apparatus, which is arranged above the stack of items and is intended for preheating and inwardly folding over the overhang of the heat shrink film wrapping and for preheating the top sheet film in the region of the upper side of the stack of items, and, in a second step, the layers of the overhang of the heat shrink film wrapping and of the top sheet film that are now lying one on top of the other are joined, at least in the region of the upper side of the stack of items, by pressing the not yet completely cooled layers lying one on top of the other of the heat shrink film wrapping and the top sheet film onto one another by means of the combined heat diverting and pressing apparatus.

By the method according to the invention, the hot gases that normally rise up quickly are directed by the combined heat diverting and pressing apparatus over the surface of the stack of items toward the middle, so that even during the shrink-wrapping of the sides of the stack of items during the upward movement of the shrinking apparatus, a preheating of the top sheet film in the region of the upper side and a preheating of the overhang of the heat shrink film wrapping take place. At the same time, the overhang is folded over inward.

Furthermore, by the combined heat diverting and pressing apparatus, the not yet completely cooled layers of the heat shrink film wrapping and the top sheet film that are lying one on top of the other are joined by pressing them onto one another. The pressure exerted while they are pressed onto one another can be varied. As a result, particularly good welding of the layers lying one on top of the other is achieved, and consequently very good climatic protection.

The top sheet film is in this case at least large enough that, after folding over the overhang, a peripheral contact between the laid-flat overhang of the heat shrink film wrapping and the top sheet film is ensured. Preferably, the top sheet film is larger than the stack of items, so that the top sheet film is folded down on all sides.

It goes without saying that the heat shrink film wrapping may also protrude on the underside beyond the lower edge of the stack of items to carry out a lower shrink wrap. If underside sealing of the stack of items is also desired, a bottom film that preferably protrudes beyond the edge and is welded to the heat shrink film wrapping when carrying out the lower shrink wrap may also be provided.

For shrinking, the shrinking apparatus may initially be made to move upward to carry out the upper shrink wrap and subsequently made to move downward to carry out the lower shrink wrap.

In the case of a special embodiment of the method, the shrinking begins at approximately half the height of the stack of items. The shrinking apparatus is initially made to move to half the height of the stack of items. Then, the shrinking apparatus is started and is initially made to move vertically upward to carry out the upper shrink wrap and, after that, is made to move vertically downward to carry out the lower shrink wrap.

In the case of a preferred embodiment of the method, it is appropriate if, at least at the beginning of the shrinking process, the overhang of the heat shrink film wrapping that protrudes on the upper side beyond the upper edge of the stack of items is made to stand up, in particular by means of an air stream which is generated by the combined heat diverting and pressing apparatus and is directed directly or indirectly outward. In the case of such an embodiment, a fan may be provided, for example, in the region of the combined heat diverting and pressing apparatus and be switched to blowing for making the overhang stand up. The stream impinging on the upper side is diverted outward and so makes the overhang stand up. In the rest of the shrinking process, for example when carrying out the upper shrinking wrap and the lower shrinking wrap, the fan may be set to sucking.

The hot gases rising up along the sides of the stack of items and diverted in a direction extending parallel to the upper side of the stack of items can be sucked away, in particular by means of the combined heat diverting and pressing apparatus. It goes without saying that other configurations are also conceivable.

At least when the shrinking apparatus is made to move vertically downward, the layers of the heat shrink film wrapping and of the top sheet film that are lying one on top of the other are joined, at least in the region of the upper side of the stack of items, by pressing the not yet completely cooled layers lying one on top of the other of the heat shrink film wrapping and the top sheet film onto one another.

Alternatively, at least when carrying out the lower shrinking wrap, the layers of the heat shrink film wrapping and of the top sheet film that are lying one on top of the other may be joined, at least in the region of the upper side of the stack of items, by pressing the not yet completely cooled layers lying one on top of the other of the heat shrink film wrapping and the top sheet film onto one another.

The invention also relates to an apparatus for shrinking a heat shrink film wrapping placed around a stack of items, in particular a palleted stack of items, with at least one shrinking apparatus, which can be made to move in a vertical direction on a frame, is formed in particular as a shrink frame and is intended for shrinking the heat shrink film wrapping by heating, wherein the heat shrink film wrapping protrudes on the upper side at least beyond the upper edge of the stack of items for the upper shrink formation and arranged on the upper side of the stack of items is a top sheet film, which preferably protrudes beyond the edge of the stack of items and can be welded to the heat shrink film wrapping.

Such apparatuses are used, for example, in the papermaking industry. Here, pallets with formats of different dimensions that have to be packed on a shrink packing line are used. The shrinking takes place in this case after placing the top sheet film onto the upper side of the stack of items and subsequently providing the heat shrink film wrapping. The overhanging ends or edges of the top sheet film and a bottom film that is possibly additionally provided between the pallet and the stack of items are in this case clamped in between the heat shrink film wrapping and the stack of items or the pallet. To prevent ingress of moisture, adequate climatic protection must be ensured. This is only the case if adequate welding is ensured between the top sheet film placed on the stack of items and the heat shrink film wrapping formed as a sleeve.

The object of the invention is to provide an apparatus by means of which the above-described disadvantages can be avoided and which ensures shrink-wrapping with adequate climatic protection by improved welding of the top sheet film and the overhang of the heat shrink film wrapping.

This object is achieved by arranging above the stack of items a combined heat diverting and pressing apparatus, intended on the one hand for diverting the hot gases rising up along the sides of the stack of items in a direction extending at least approximately parallel to the upper side of the stack of items, for preheating and inwardly folding over the overhang of the heat shrink film wrapping and for preheating the top sheet film in the region of the upper side of the stack of items, and on the other hand for subsequently joining the folded-over overhang of the heat shrink film wrapping and of the top sheet film, at least in the region of the upper side of the stack of items, by pressing the not yet completely cooled layers lying one on top of the other of the heat shrink film wrapping and the top sheet film onto one another.

By the apparatus according to the invention, the hot gases that normally rise up quickly are directed by the combined heat diverting and pressing apparatus over the surface of the stack of items toward the middle, so that even during the shrink-wrapping of the sides of the stack of items during the upward movement of the shrinking apparatus, a preheating of the top sheet film in the region of the upper side and a preheating of the overhang of the heat shrink film wrapping take place. At the same time, the overhang is folded over inward.

Furthermore, by the combined heat diverting and pressing apparatus, the not yet completely cooled layers of the heat shrink film wrapping and the top sheet film that are lying one on top of the other are joined by pressing them onto one another. The pressure exerted while they are pressed onto one another can be varied. As a result, particularly good welding of the layers lying one on top of the other, and consequently very good climatic protection, are achieved.

The top sheet film is in this case at least large enough that, after folding over the overhang, a peripheral contact between the laid-flat overhang of the heat shrink film wrapping and the top sheet film is ensured. Preferably, the top sheet film is larger than the stack of items, so that the top sheet film is folded down on all sides.

It goes without saying that the heat shrink film wrapping may also protrude on the underside beyond the lower edge of the stack of items to carry out a lower shrink wrap. If underside sealing of the stack of items is also desired, a bottom film that preferably protrudes beyond the edge and is welded to the heat shrink film wrapping when carrying out the lower shrink wrap may also be provided.

Preferably, a plate aligned parallel to the upper side of the stack of items may be provided as the combined heat diverting and pressing apparatus.

At least the region of the combined heat diverting and pressing apparatus that can be brought into contact with the upper side of the stack of items is made a little smaller than the inside dimensions of the shrinking apparatus, to ensure that the shrinking apparatus can be allowed to move sufficiently during the upper shrink wrap.

Preferably, the plate may have a coating, preferably a Teflon coating, on the side facing the stack of items.

The side edges of the combined heat diverting and pressing apparatus may be approximately in line with the side edges of the stack of items. However, it is also quite conceivable for the combined heat diverting and pressing apparatus to be a little smaller than the dimensions of the stack of items. In such a case, suitable means for allowing a diversion of the hot gases are provided.

Preferably, the combined heat diverting and pressing apparatus protrudes laterally beyond the contour of the stack of items.

The combined heat diverting and pressing apparatus may have at least one clearance, preferably arranged approximately in the middle of the combined heat diverting and pressing apparatus, for the upward exiting of the hot gases flowing parallel to the upper side of the stack of items in the direction of the middle.

Through the clearance, the diverted hot gases that flow from the edge of the upper side in the direction of the middle of the upper side are carried away upward. The flow velocities thereby occurring also intensify the folding over of the overhangs and the welding of the overhang to the top sheet film. It goes without saying that it is also possible for two clearances arranged one behind the other to be provided, in particular in the longitudinal extent of the combined heat diverting and pressing apparatus.

Preferably, the position of at least one clearance may be variable, to change the point at which the hot gases initially flowing parallel to the upper side of the stack of items are diverted upward. An embodiment in which the clearance is, for example, part of a covering plate or a sliding plate that can be made to move in a horizontal direction with respect to the heat diverting and pressing apparatus, within a contour of an opening provided in the each diverting and pressing apparatus, is conceivable.

Preferably, a transporting apparatus for sucking away the hot gases flowing parallel to the upper side of the stack of items in the direction of the middle of the stack of items may be provided over at least one clearance. The transporting apparatus has the effect that a negative pressure is produced in the region of the upper side of the stack of items, and consequently a greater amount of hot gases is sucked into the region between the upper side and the combined heat diverting and pressing apparatus and diverted. At the same time, the transporting apparatus may also be used for blowing, which serves for the possible initial standing up of the overhang of the heat shrink film wrapping.

A reducing damper may be provided in the region of at least one clearance. This damper is in the closed position during the placement of the combined heat diverting and pressing apparatus, and consequently when the not yet completely cooled layers lying one on top of the other of the heat shrink film wrapping and the top sheet film are pressed onto one another. This prevents the top sheet film from being drawn upward in the region of the clearance by the thermal effect of the hot air rising up from the heated surface of the top sheet film. At the same time, the reducing damper also allows the volumetric flow to be controlled during the shrinking.

To prevent excessive heating of the combined heat diverting and pressing apparatus in cases of high pallet capacities, at least the region of the combined heat diverting and pressing apparatus that can be brought into contact with the not yet completely cooled layers lying one on top of the other of the heat shrink film wrapping and the top sheet film may be coolable.

For example, a cooling system that is provided in the region of the underside of the combined heat diverting and pressing apparatus and is cooled by water, air or some other suitable cooling medium is conceivable.

If the apparatus according to the invention is to be used for packing stacks of items of different dimensions, it is appropriate if, for adapting the distance between the stack of items, on the one hand, and at least one heating bar of the shrink frame, formed as a shrinking apparatus, that extends substantially parallel to the corresponding side face of the stack of items, on the other hand, at least one heating bar is variable in its position by being made to move in a moving direction aligned substantially orthogonally in relation to the side face. This adaptation ensures that the stack of items is subjected to approximately the same heating output in the region of all the side faces, in order that a uniform shrinkage result is achieved.

If only an adaptation with respect to the length or the width of the stack of items is desired, it is adequate if only one heating bar is movable. Alternatively, the two opposite heating bars of a shrink frame comprising a total of four heating bars may be movable with respect to each other. In the case of an adaptation to the width and to the length of a stack of items, at least two adjacent heating bars are movably formed.

Preferably, at least one of the two heating bars extending substantially orthogonally in relation to the transporting direction of the stack of items is variable in its position by being made to move, to adapt the distance between the stack of items on the one hand and at least one of the heating bars extending substantially orthogonally in relation to the transporting direction of the stack of items.

The heating bar that can be made to move in relation to the remaining shrink frame may be arranged on at least one rail, provided on the remaining shrink frame, and a drive may be provided for making it move. The rail may be attached either to the upper side or to the underside of the shrink frame, the heating bar being fastened to the rail by means of suitable measures. It is also conceivable for the heating bar to have at both its ends rollers which travel on a rail mounted on the upper side of the shrink frame. A kind of conveyor belt that is led between two deflecting rollers and to which the heating bar is fastened is also conceivable.

To ensure that the combined heat diverting and pressing apparatus has an approximately horizontal alignment, in particular in the state in which it is lying against the upper side of the stack of items, an apparatus which prevents tilting of the combined heat diverting and pressing apparatus, in particular in the state in which it is lying against the upper side of the stack of items, may be provided.

At least one heating bar may comprise a number of heating segments, preferably a number of heating segments that can be activated separately from one another. In the case of separate activation, the heating segments can to this extent be switched on and off separately. Such an embodiment is appropriate, since it is then possible to deactivate the heating segments of the heating bars that are no longer acting on the region enclosed by the movable heating bar(s) and possibly by the non-movable heating bar(s) or part-regions of it or them.

BRIEF DESCRIPTION OF THE DRAWINGS

An illustrated embodiment of the invention that is represented in the drawings is explained below. In the drawing.

DETAILED DESCRIPTION OF THE DRAWINGS

Figure 1:
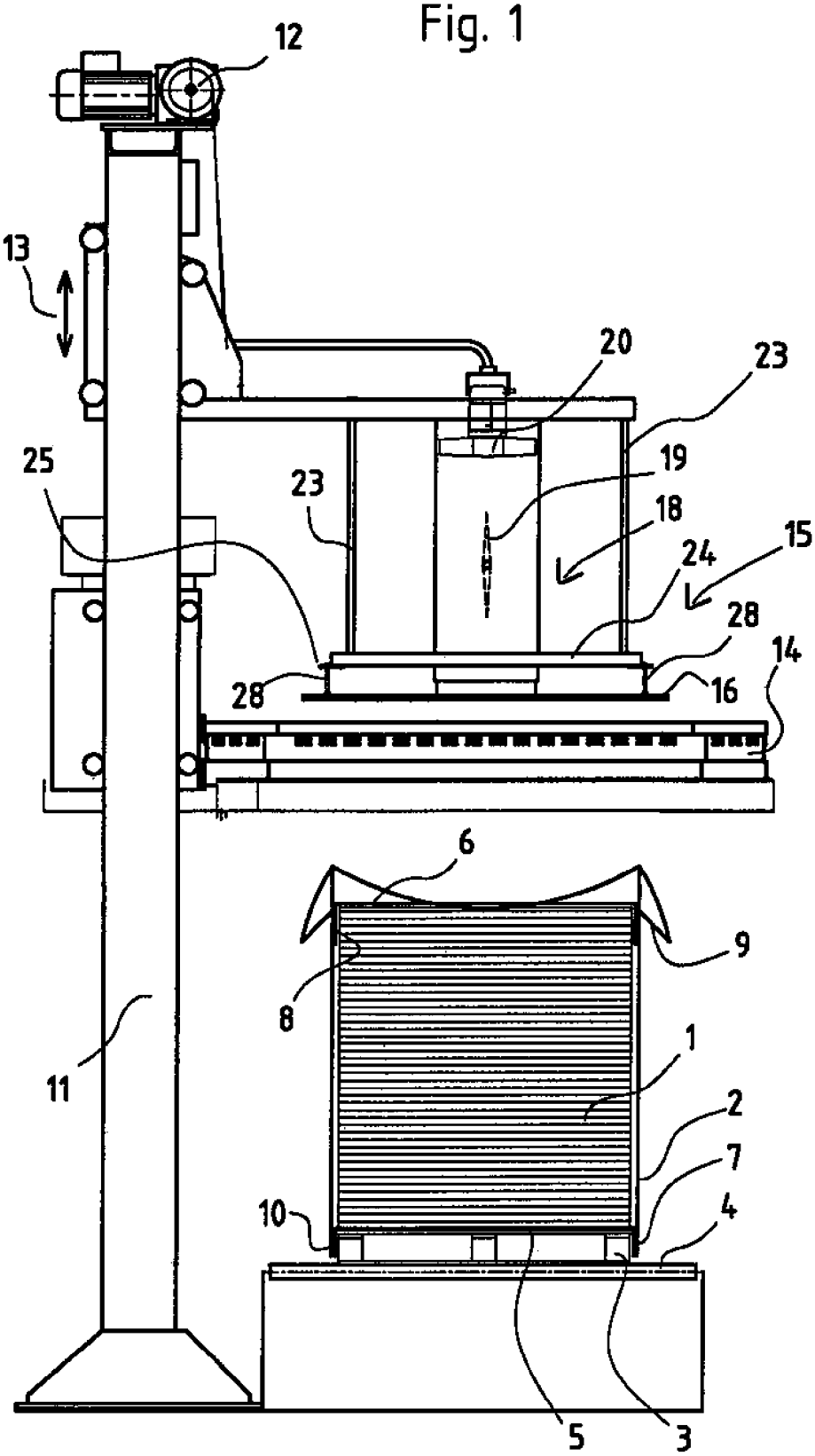
FIG. 1 shows a side view of an apparatus according to the invention with a shrink film and a combined heat diverting and pressing apparatus.

In all the figures, the same reference numerals are used for identical or similar components.

FIG. 1 shows a side view of an apparatus according to the invention for shrinking a heat shrink film wrapping 2 placed around a stack of items 1. In the illustrated embodiment represented, the stack of items 1 is resting on the underside on a pallet 3. The pallet 3 itself is resting on a conveyor 4.

A bottom film 5 is initially placed on an empty pallet 3, the bottom film 5 protruding at the edges beyond the pallet 3. The stack of items 1, for example paper, is set down on the bottom film 5. Then, a top sheet film 6 is placed onto the stack of items 1 on the upper side, the top sheet film 6 also protruding beyond the edge of the stack of items 1. The top sheet film 6 is usually cut to length from a roll of continuous film. Both the overhanging edge 7 of the bottom film 5 and the overhanging edge 8 of the top sheet film 6 are folded down.

In a further method step that is not represented, a heat shrink film wrapping 2 is then placed around the stack of items 1. For this purpose, the stack of items 1 may, for example, be moved against a film curtain comprising a heat shrink film that extends transversely in relation to the conveying direction. As it runs through, the heat shrink film comes to lie around the stack of items 1. In the region of the side facing away from the moving direction, the heat shrink film wrapping 2 placed in this way around the stack of items 1 is usually provided with a finishing weld by a vertically aligned welding beam. In this way, a sleeve is formed, such as that represented in FIG. 1.

On the upper side and on the underside, the heat shrink film wrapping 2 protrudes beyond the upper edge and the lower edge, respectively, of the stack of items 1 to form a respective overhang 9 and 10 for the later upper shrink formation and lower shrink formation. The folded-over edges 8, 7 of the top sheet film 6 and of the bottom film 5 are in this case located between the heat shrink film wrapping 2 and the stack of items 1 or the pallet 3.

Provided on a frame 11 alongside the conveyor 4 is a shrink frame 14, which can be made to move in a vertical direction (arrow 13) by means of a drive 12 and comprises four heating bars 14*a* for shrinking heat shrink film wrapping by heating. At the same time, a combined heat diverting and pressing apparatus 15, which can likewise be made to move in a vertical direction (arrow 13) is provided on the frame 11. In the illustrated embodiment represented, this apparatus comprises a plate 16 aligned parallel to the upper side of the stack of items 1, the plate 16 protruding beyond the contour of the stack of items 1 by approximately 50 mm on all sides in the illustrated embodiment represented.

On the side facing the stack of items 1, the plate 16 has a coating, for example a Teflon coating, to avoid sticking to the top sheet film 6. Provided in the middle of the plate 16 in the case of the illustrated embodiment represented in FIGS. 1 to 8 is a clearance 17 for the exiting of hot gases. This clearance 17 is adjoined on the upper side by a channel portion 18, in which a reducing damper 19 and a transporting apparatus 20 formed as a fan are provided.

Figure 8:
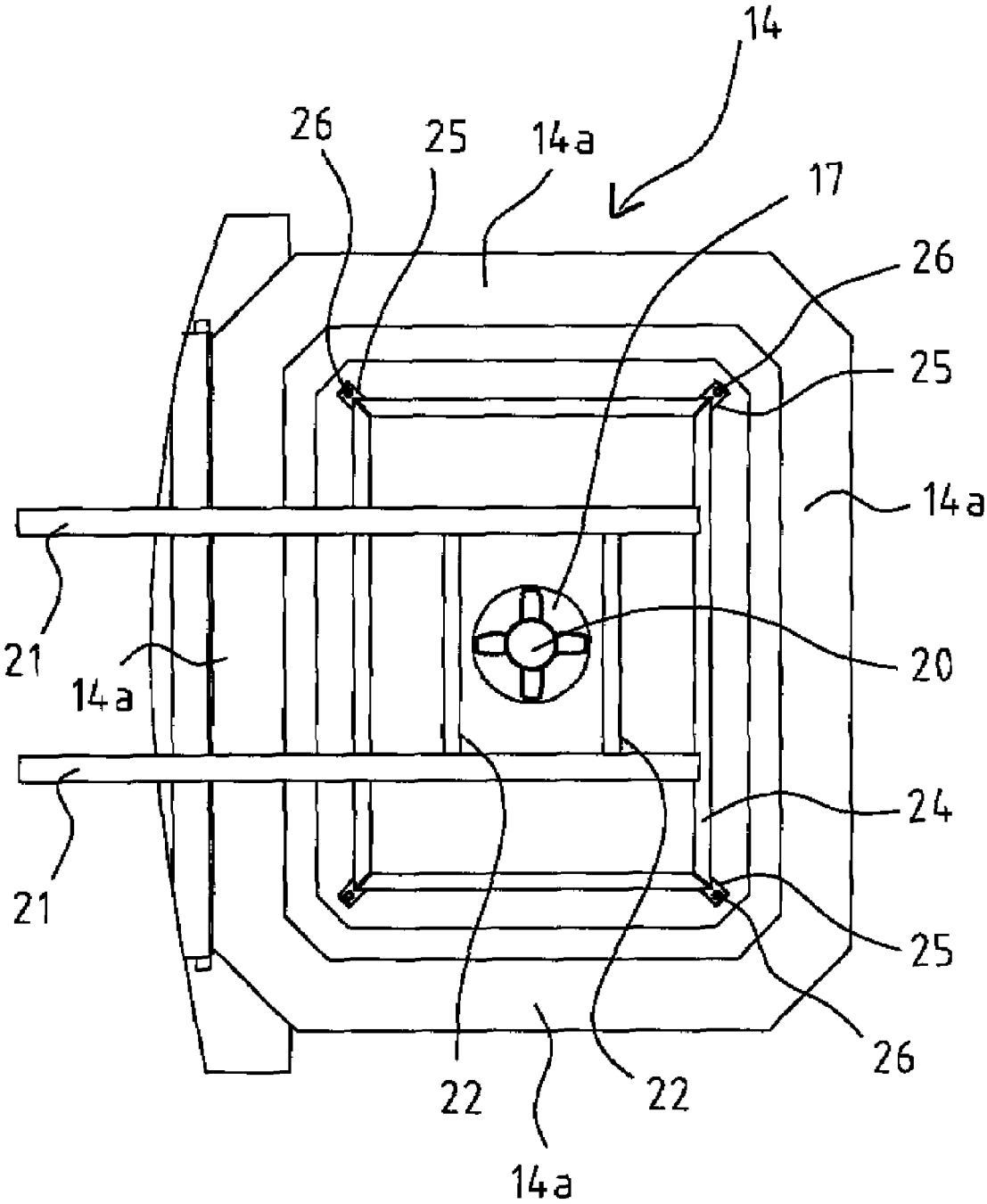
FIG. 8 shows a plan view of the subject matter that is shown in FIG. 1

In FIG. 8, the configuration of the combined heat diverting and pressing apparatus 15 is represented in detail. As this FIG. reveals, the combined heat diverting and pressing apparatus 15 is fastened to two struts 21, which for their part are connected to the frame 11. The struts 21 are fixed with respect to each other by means of cross struts 22.

Provided on the struts 21 on the underside are holding elements 23, which are formed as rods and at the lower ends of which a four-cornered frame 24 is fastened. In each corner, the frame 24 has an outwardly facing holding plate 25, in each case with a bore 26.

As revealed by FIG. 8 in conjunction with, for example, FIG. 4, the plate 16 of the combined heat diverting and pressing apparatus 15 is suspended at a distance below the frame 24 to form a free space 27.

For this purpose, fastening pins 28 with a thickening 29 at the end are integrally formed on the upper side of the plate 16. Each fastening pin 28 is guided in the associated bore 26, the thickening 29 being larger than the diameter of the bore 26 and being located above the holding plate 25.

When the plate 16 is in contact with the upper side of the stack of items 1, the fastening pins 28 are displaced in the bores 26, and the free space 27 is thereby reduced. To make such a displacement of the plate 16 with respect to the frame 24 possible, the channel portion 18 is also correspondingly formed. As FIG. 4 reveals, the channel portion 18 is subdivided into a lower part-channel portion 18*a* with a smaller contour and an upper part-channel portion 18*b* with a larger contour, so that the two part-channel portions 18*a*, 18*b* are displaceable one inside the other.

The special configuration of the combined heat diverting and pressing apparatus 15 allows pressing only to take place with the actual weight of the plate 16. Only when the free space 27 has been overcome is it possible to work with a higher pressing pressure, since then the force of the drive 12 also acts in addition to the weight of the remaining parts of the combined heat diverting and pressing apparatus 15.

The mode of operation according to FIGS. 1 to 7 is as follows:

In FIG. 1, the wrapped stack of items 1 is ready for shrinking. The overhang 9 protruding upward beyond the upper edge of the stack of items 1 is still undirected, i.e. it is partially standing upright, partially folded over outward or inward.

Figure 2:
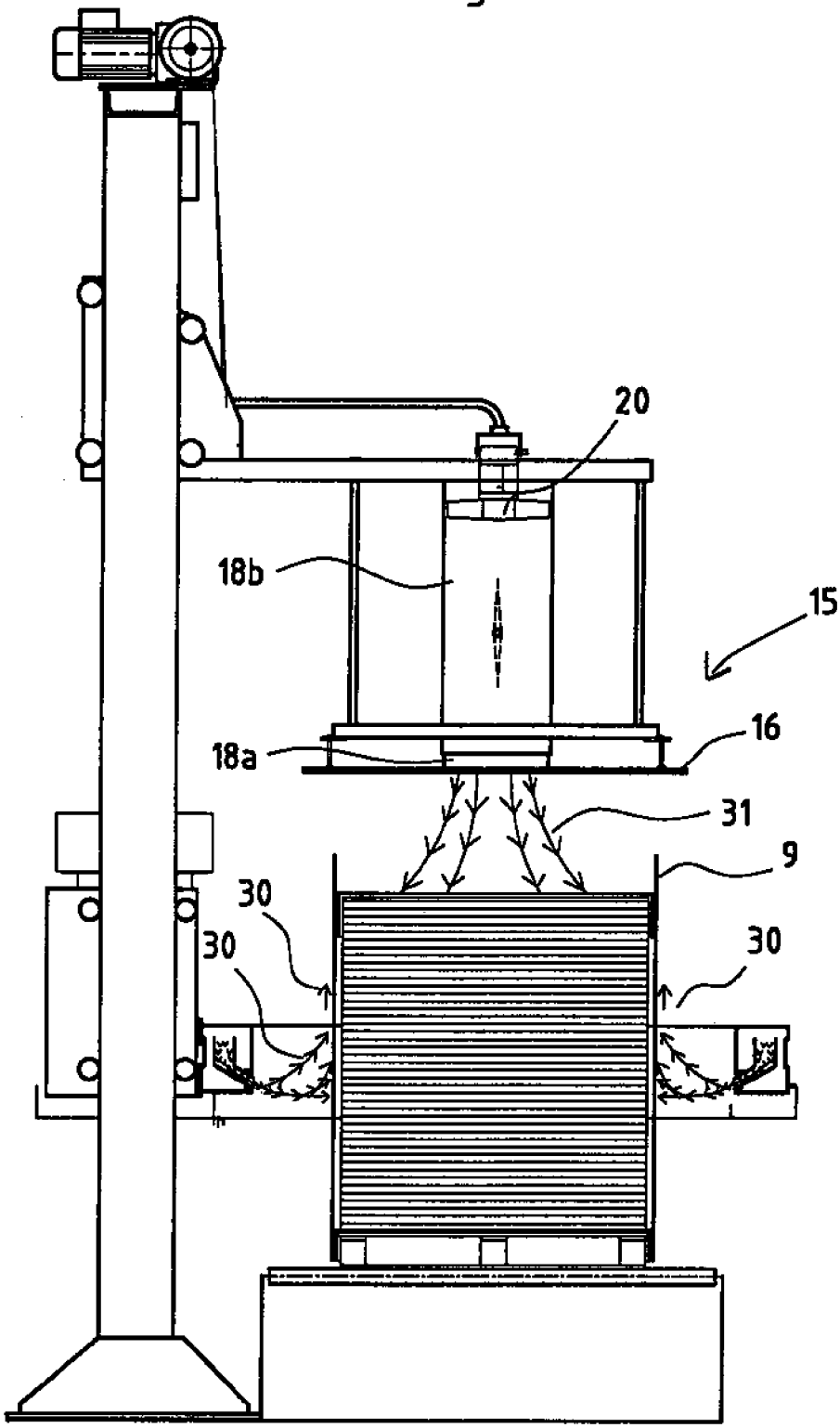
FIGS. 2-7 show different positions of the shrink film and the combined heat diverting and pressing apparatus.

Then the shrink frame 14 moves into the position represented in FIG. 2, which corresponds to approximately half the height of the stack of items 1. Only when this position is reached is the shrink frame 14, which is represented in section in FIGS. 2 to 7, started. The hot gases flow upward in the direction of the arrows 30 along the sides of the stack of items 1. The transporting apparatus 20 is in this case set to blowing, so that air is blown in the direction of the arrows 31 onto the upper side, and so the upper-side overhang 9 is made to stand up. The reducing damper 19 is in this case in the open position.

Figure 3:
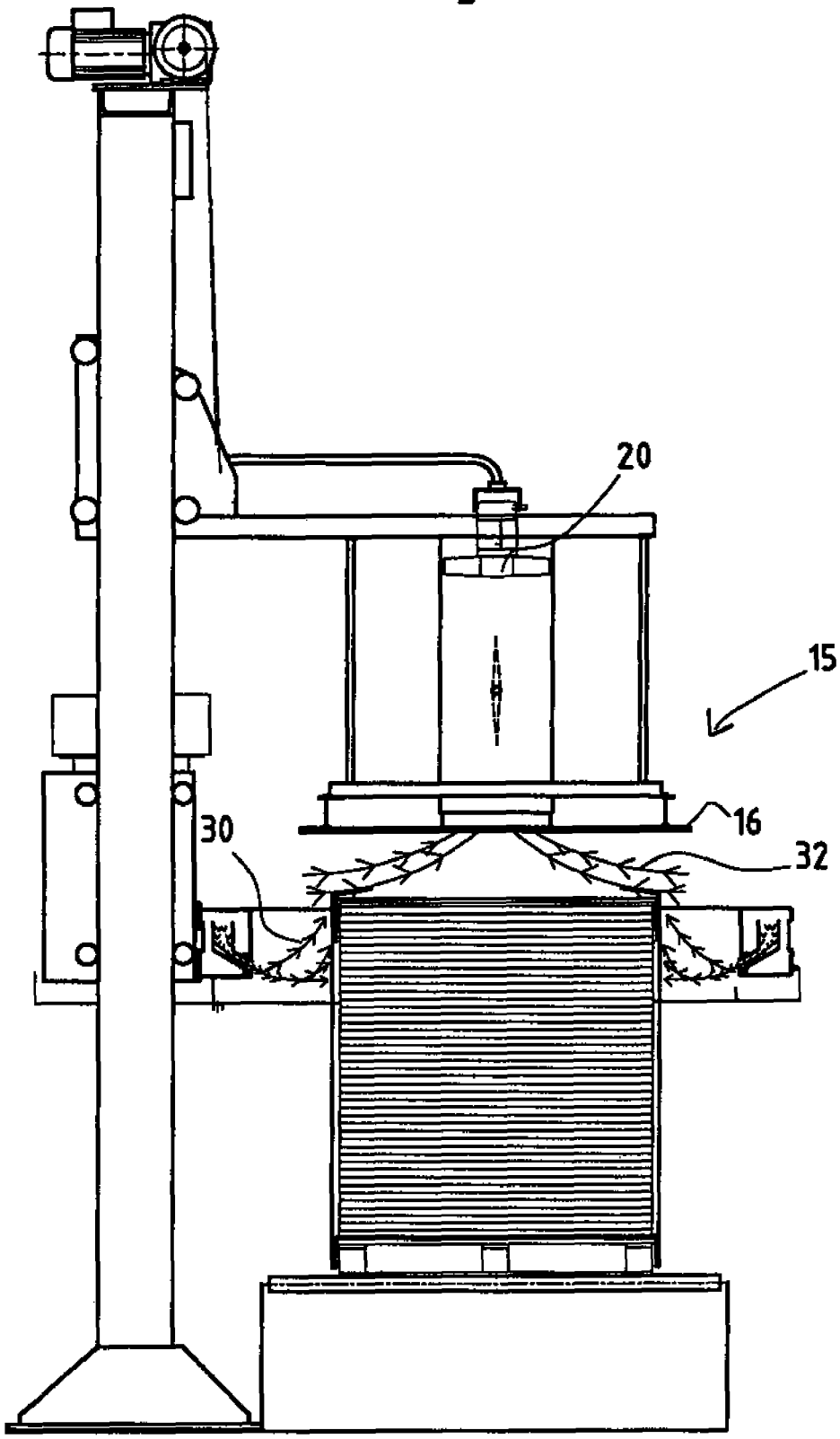

During the moving up of the shrink frame 14, as represented in FIG. 3, the distance between the heat diverting and pressing apparatus 15 and the upper side of the stack of items 1 is reduced. In FIG. 2, the distance is approximately 500 mm. In FIG. 3, the distance has been reduced to approximately 200 mm.

In the position represented in FIG. 3, the transporting apparatus 20 has already been set to suction removal, so that the hot gases flowing upward along the sides (arrows 30) are diverted in a direction extending parallel to the upper side of the stack of items 1 (arrows 32). In this way, the heat shrink film wrapping 2 and the top sheet film 6 in the region of the upper side are also sufficiently heated for a good upper shrink wrap.

Figure 4:
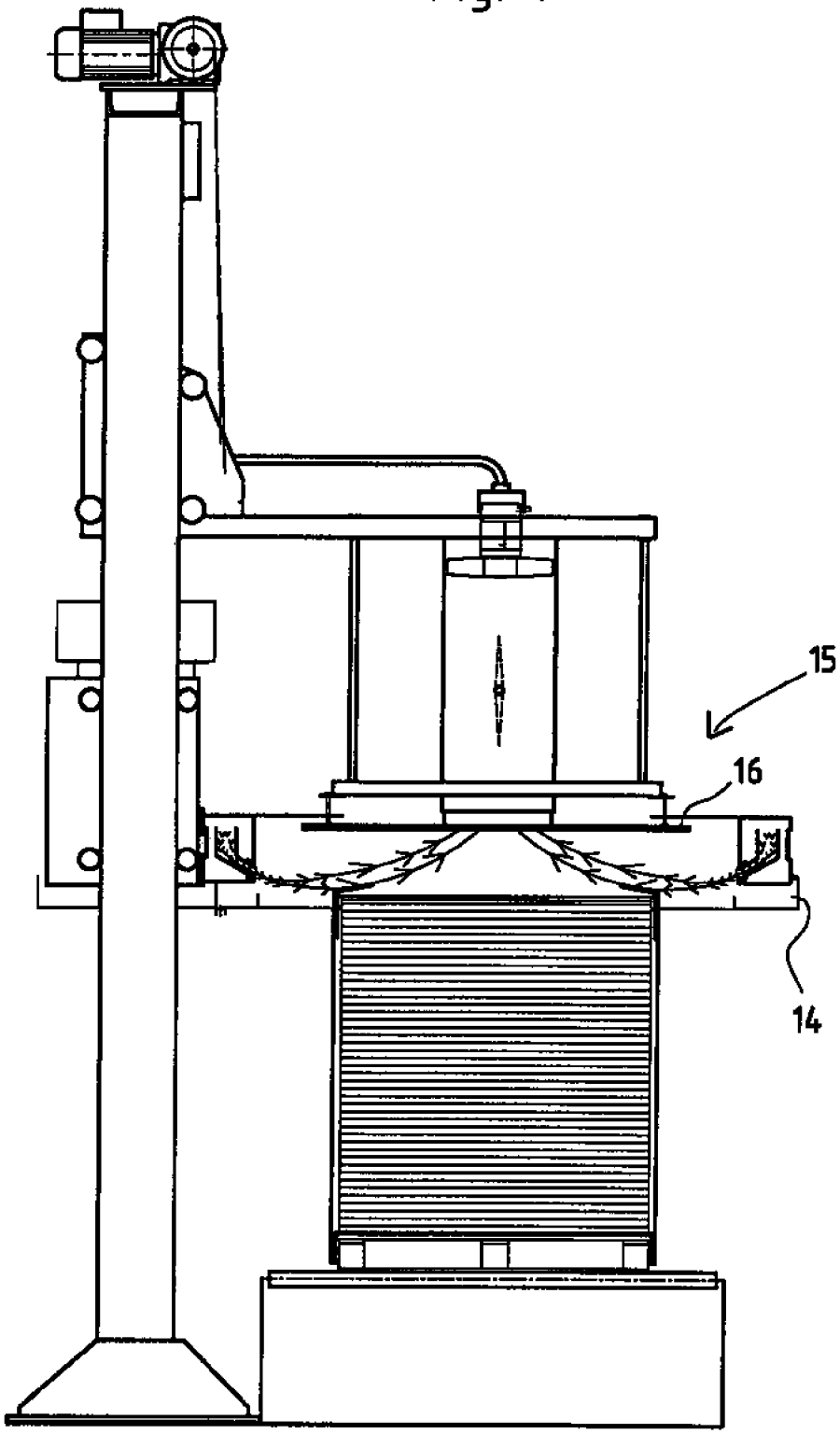
Figure 5:
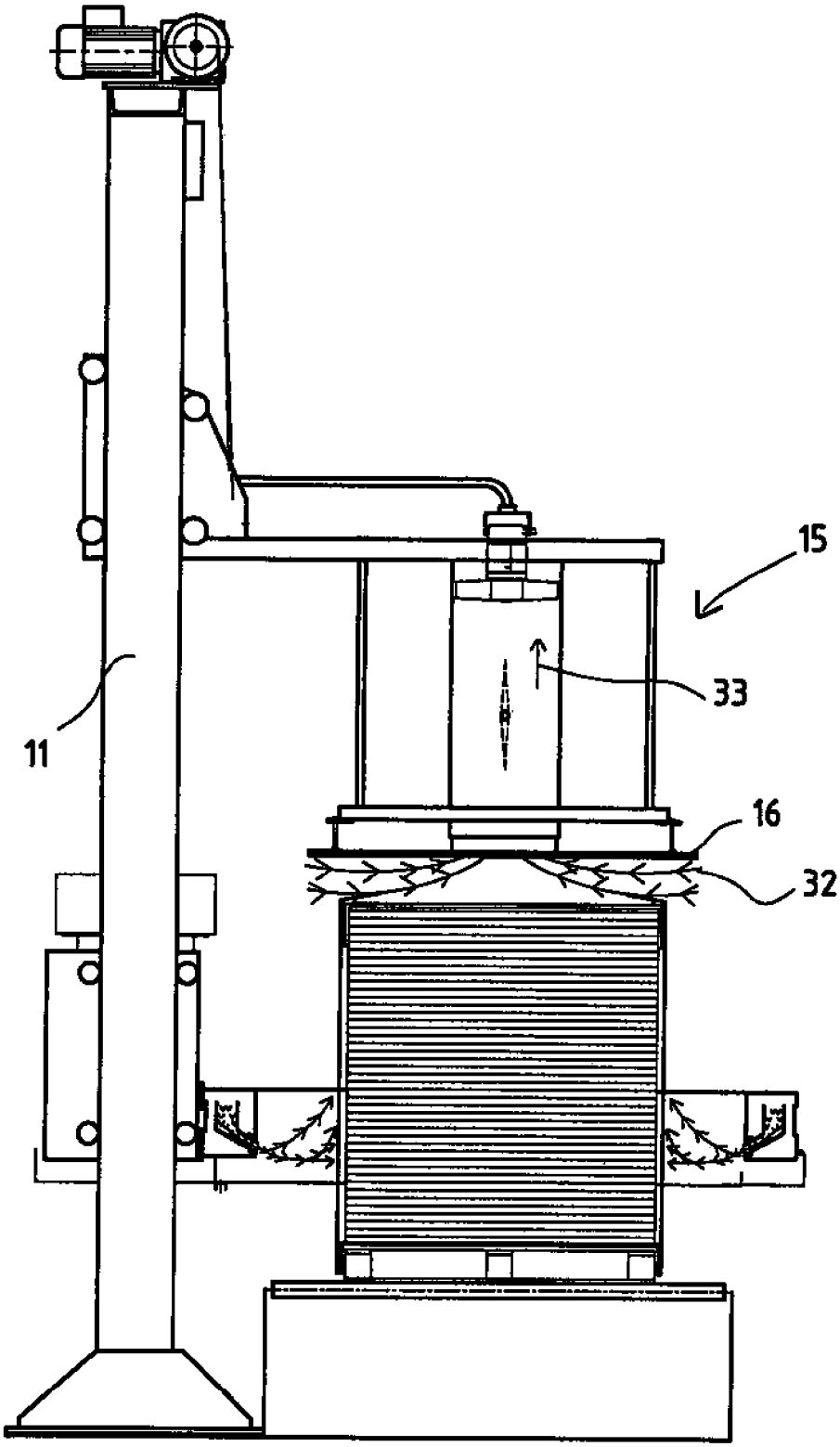

In FIG. 4, the shrink frame 14 has reached its uppermost position. Then, the shrink frame 14 is made to move vertically downward for shrink-wrapping the sides, in particular in the lower region of the stack of items 1, as represented in FIG. 5. When it is being made to move vertically downward in this way, the hot gases (arrows 32) continue as before to be sucked away by means of the transporting apparatus 20 through the clearance 17, in the direction of the arrows 33.

Figure 6:
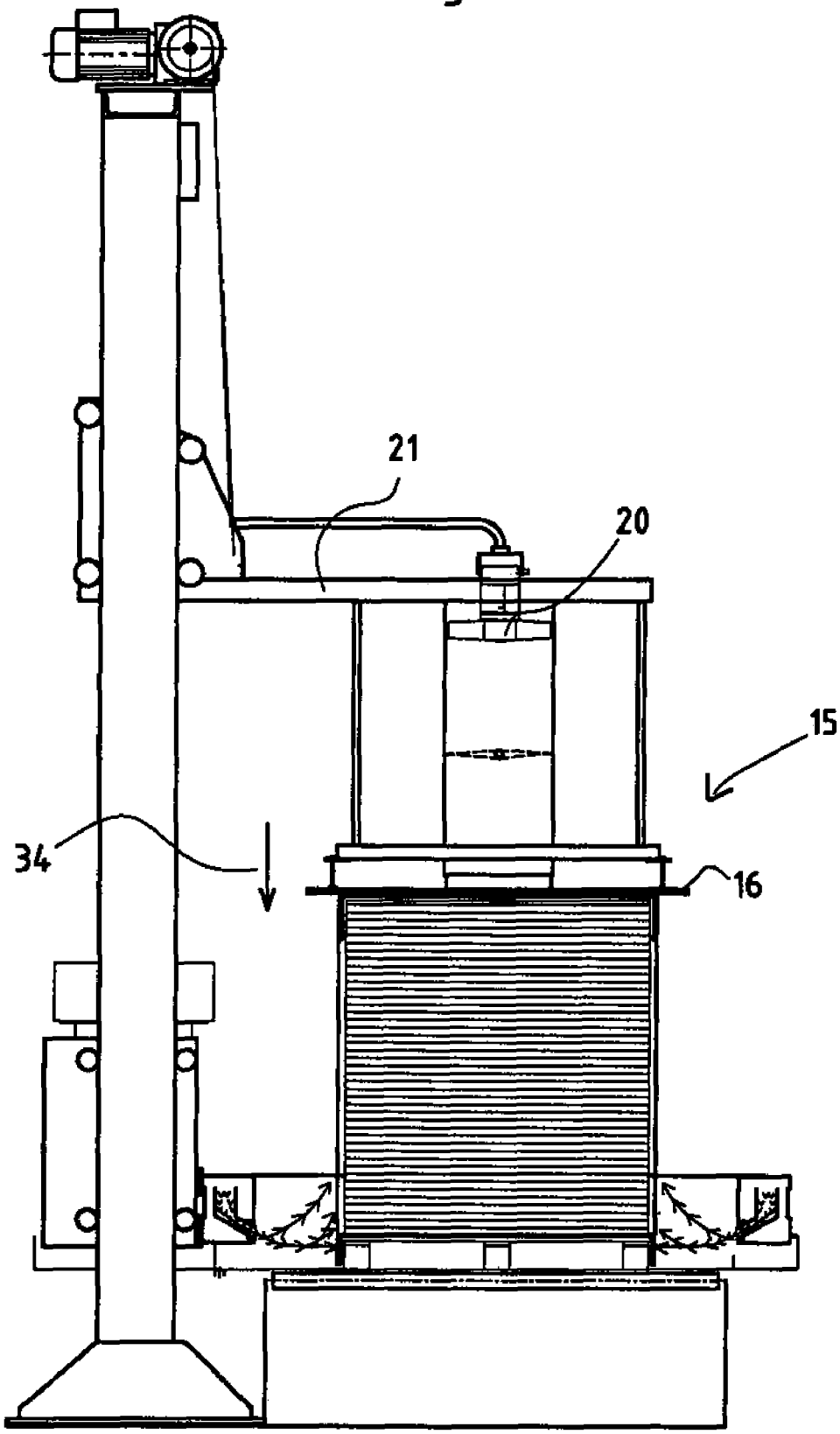

In FIG. 6, the shrink frame 14 has reached its lowermost position to carry out the lower shrink formation. In the position represented in FIG. 6, the transporting apparatus 20 has been switched off and the reducing damper 19 is closed. The combined heat diverting and pressing apparatus 15 is pressed in the direction of the arrow 34 onto the upper side of the stack of items 1, so that the layers of the heat shrink film wrapping 2 and of the top sheet film 6 that are lying one on top of the other are joined to one another in the region of the upper side by pressing the not yet completely cooled layers lying one on top of the other. It goes without saying that the pressing may also take place at an earlier point in time.

Figure 7:
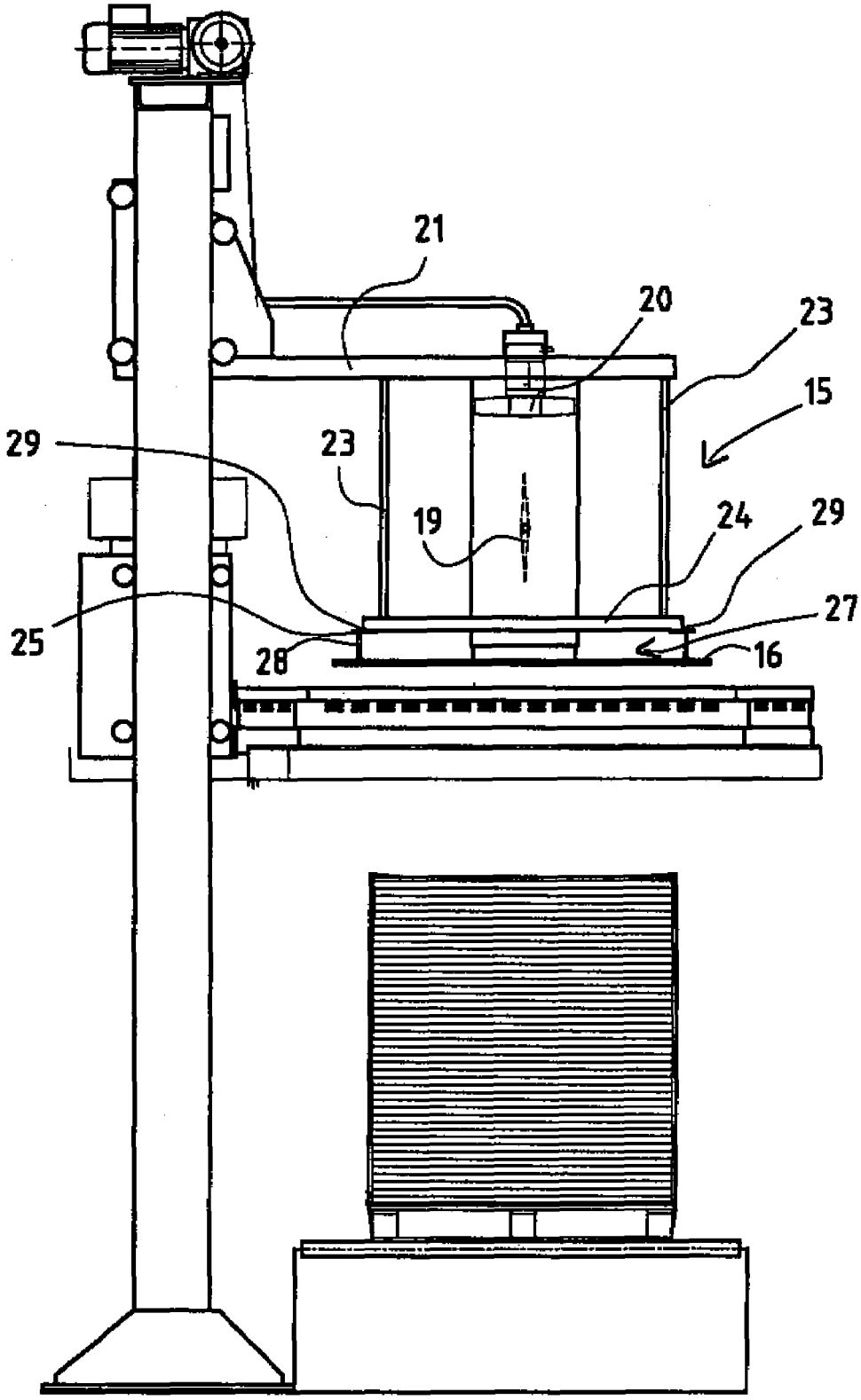

After the shrinking process, the shrink frame 14 and the heat diverting and pressing apparatus 15 are displaced again into the position represented in FIG. 7, and the wrapped and shrunk stack of items 1 is transported away by means of the conveyor 4.

In FIGS. 9 to 14, a further illustrated embodiment of the apparatus according to the invention is shown. Here, the heating bar 14*a* facing orthogonally in relation to the transporting direction 35 is formed such that it can be made to move with respect to the rest of the shrink frame 14. This makes it possible to adapt the distance between the stack of items 1 on the one hand and the movable heating bar 14*a* of the shrink frame 14 formed as a shrink apparatus. Being allowed to move in this way is appropriate if stacks of items 1 of different dimensions, such as for example length, are to be packed.

Figure 9:
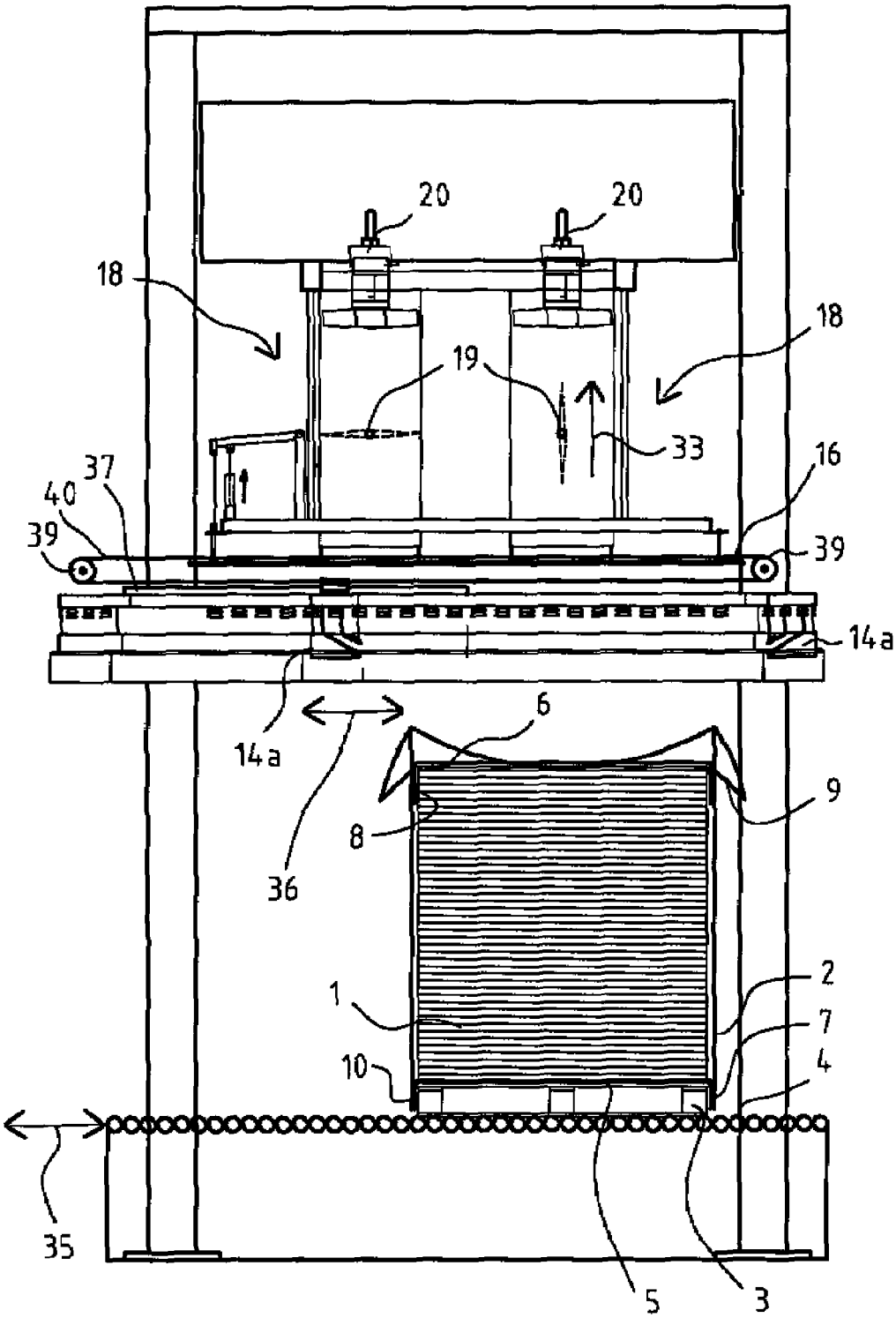
FIGS. 9-12 show side views of another embodiment of an apparatus according to the invention.
Figure 10:
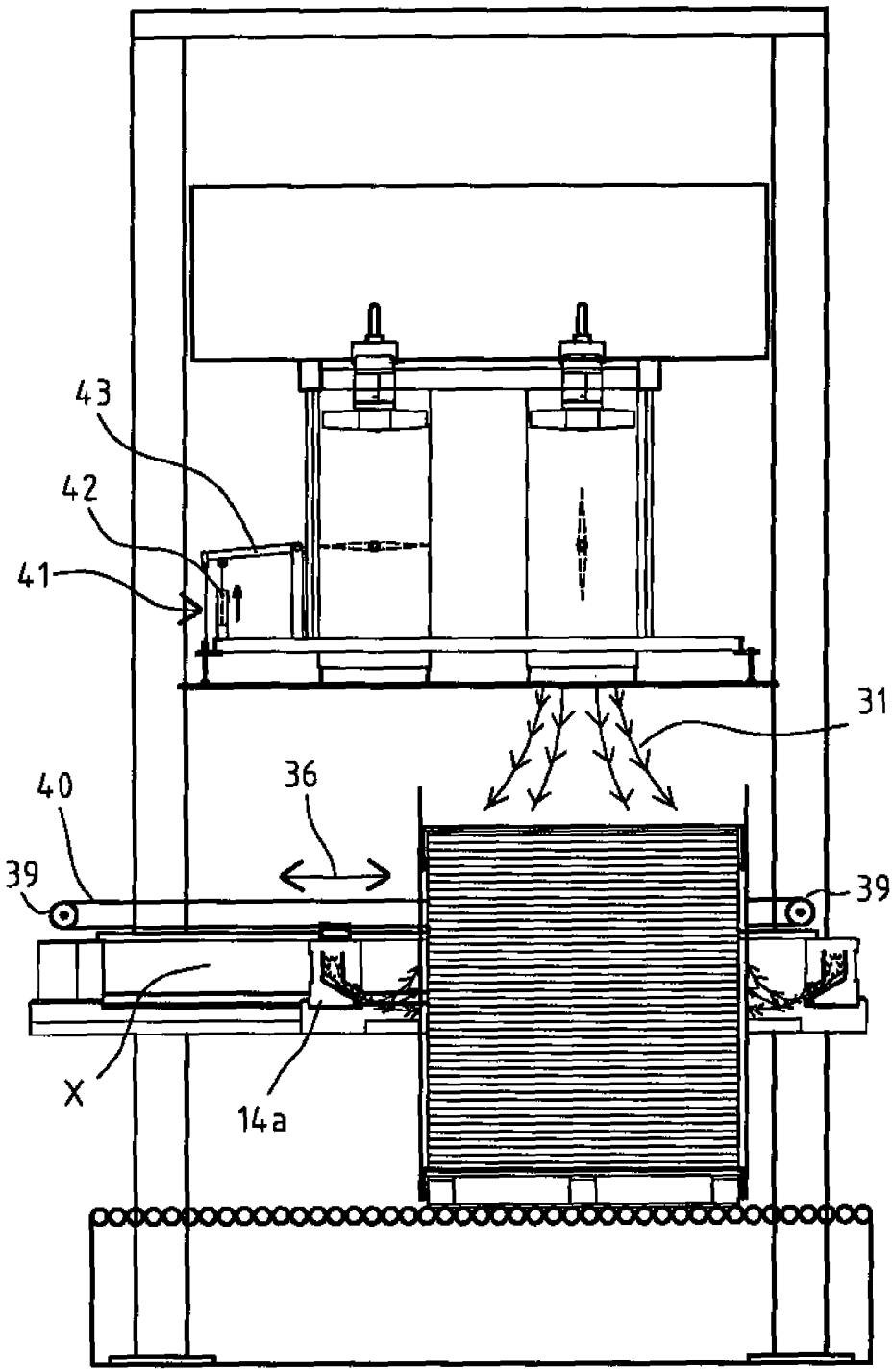
Figure 14:
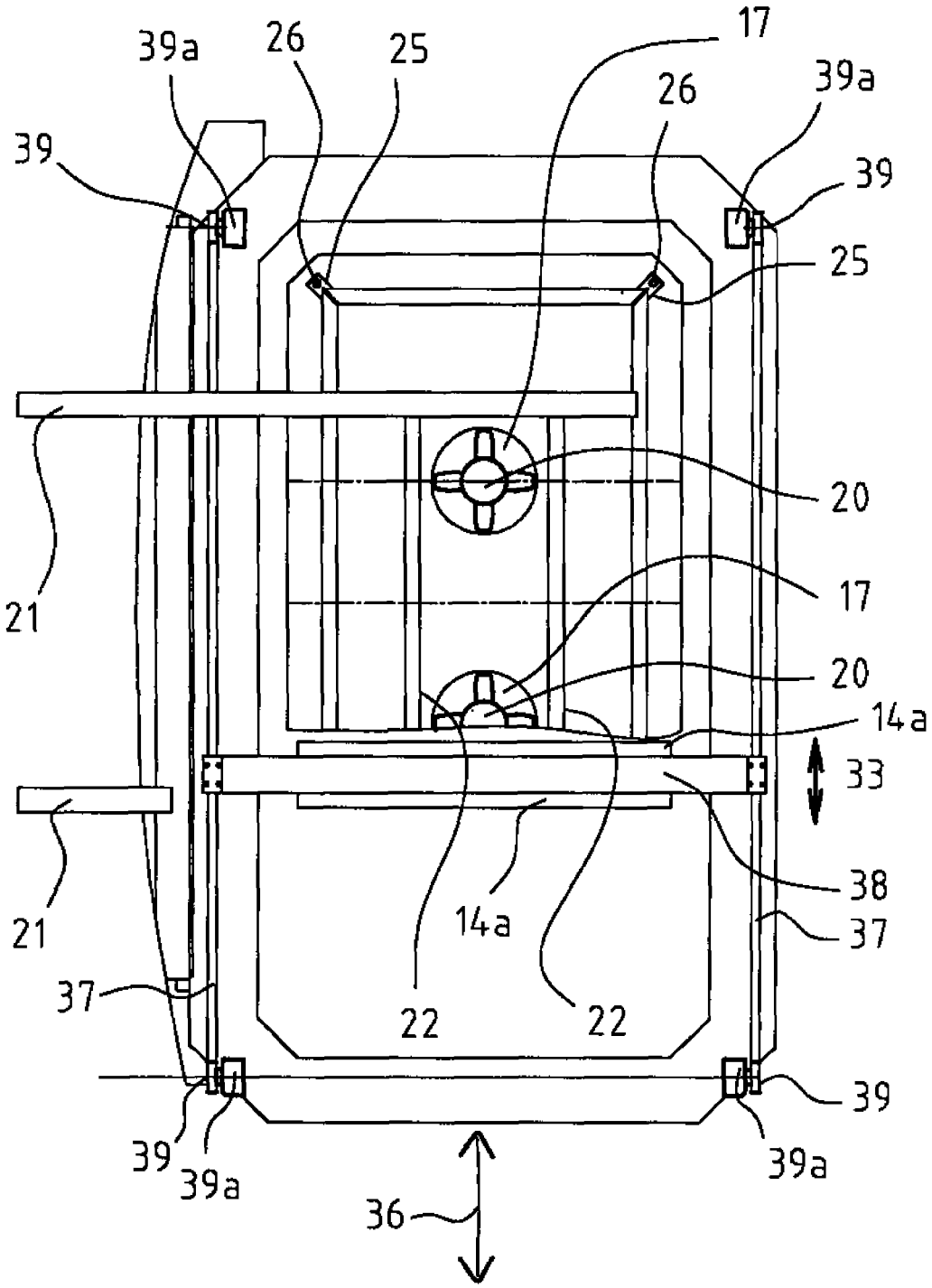

In FIGS. 9, 10 and 14, a stack of items 1 of a relatively small length is represented. Therefore, the left-hand heating bar

14*a*, represented in FIGS. 9 and 10, has been made to move in the direction of the opposite heating bar 14*a* in a moving direction 36 aligned substantially orthogonally in relation to the side face.

Figure 11:
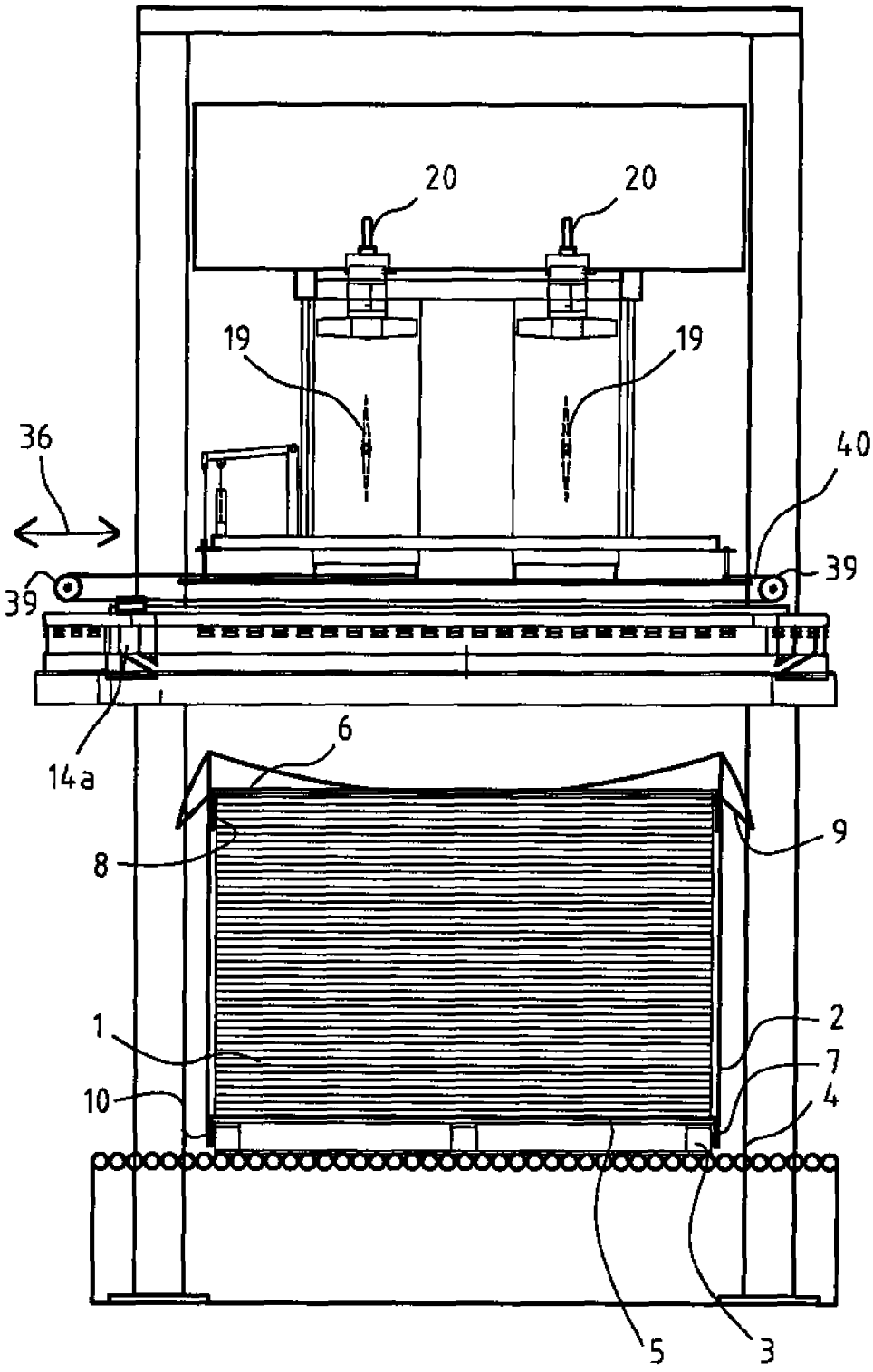
Figure 12:
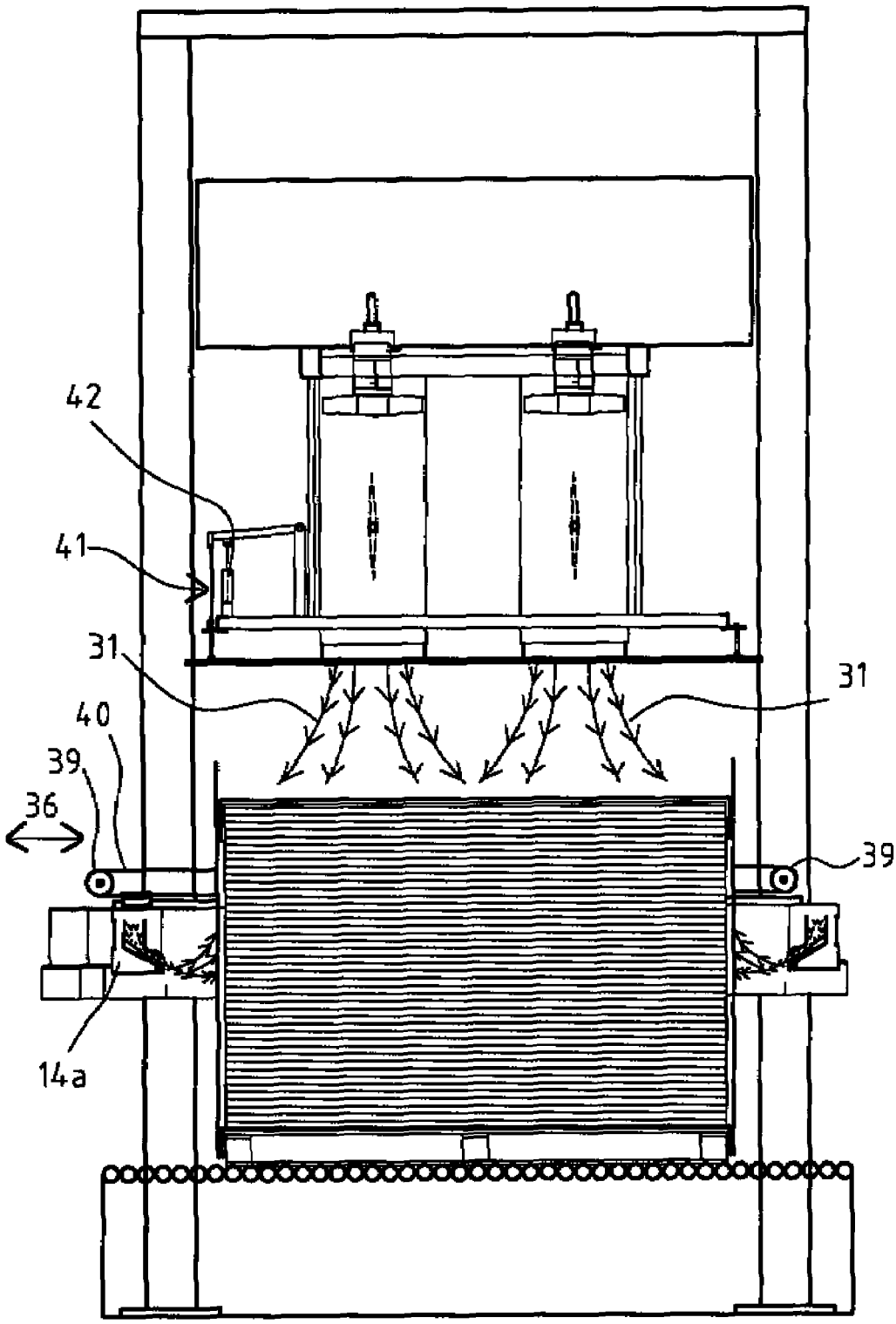
Figure 13:
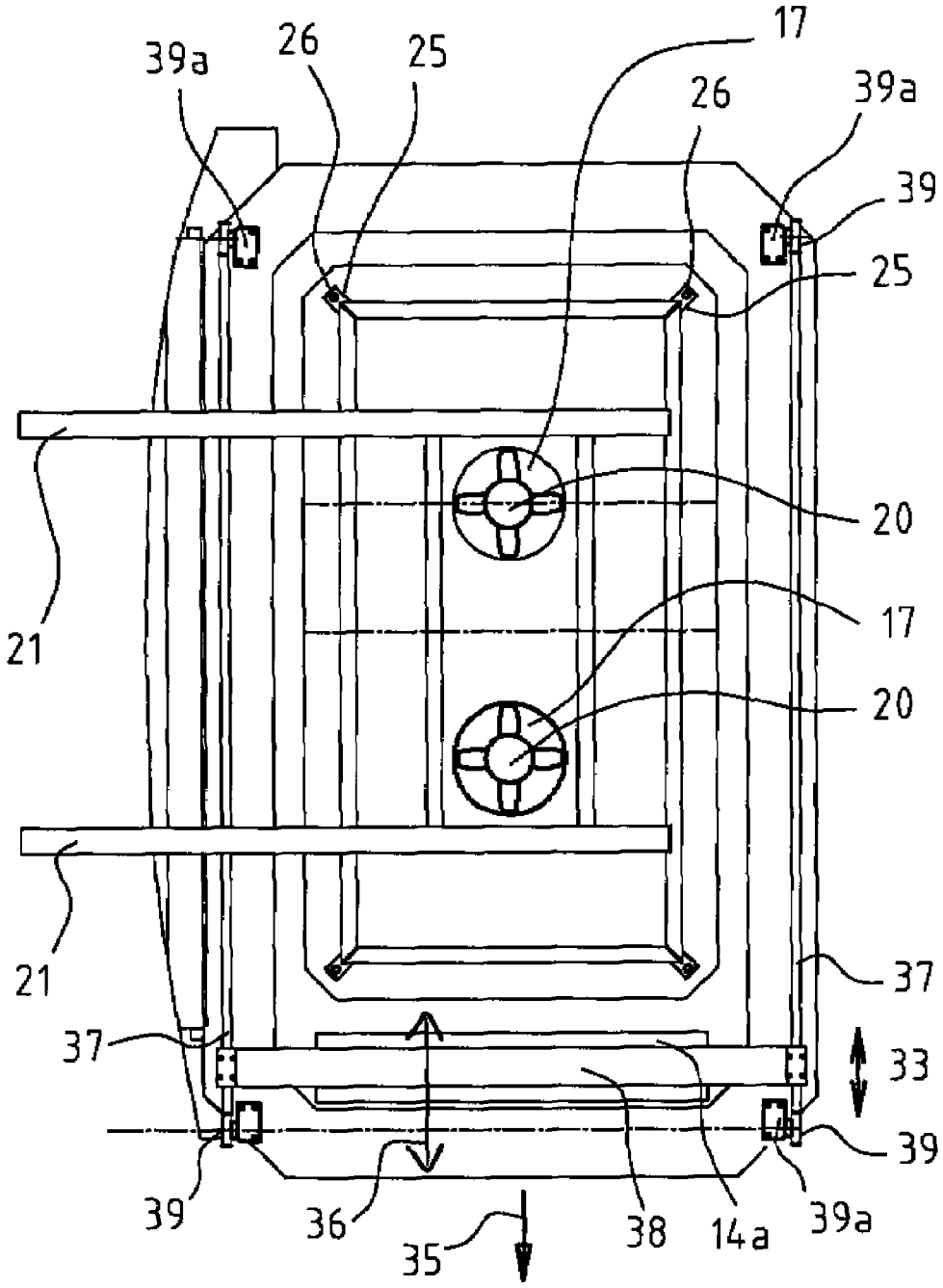
FIG. 13 shows a plan view of the subject matter that is shown in FIGS. 11 and 12 and FIG. 14 shows a plan view of the subject matter that is shown in FIGS. 9 and 10.

In FIGS. 11, 12 and 13, the arrangement of the heating bars 14*a* in the case of a stack of items 1 of a relatively great length is represented. Here, the left-hand heating bar 14*a* has been made to move outward almost completely.

In the illustrated embodiment of the invention represented for example in FIGS. 10 and 11, the heating bar 14*a* can be made to move into two different positions. It goes without saying that, to increase adaptability, it is also possible to allow intermediate positions of the movable heating bar 14*a* to be adopted.

To allow this movement, rails 37 are provided on the upper side of the shrink frame 14. The heating bar 14*a* is displaceably mounted on the two rails 37 by means of guiding carriages 38. To make it move, a toothed belt 40 stretched between two deflecting rollers 39 acts on the heating bar 14*a*. A dedicated drive for driving the toothed belts 40 is not represented. The deflecting rollers 39 are fastened to the shrink frame 14 by means of bearing brackets 39*a*. For a better overview, the toothed belt 40 is not depicted in FIGS. 13 and 14.

If the two heating bars 14*a* adjacent to the ends of the movable heating bar 14*a*, along with the rails 37 arranged on the upper side, respectively comprise a number of separately controllable, and to that extent activatable, heating segments, it is advisable for the heating segments in the region X of the heating bars 14*a* that protrudes at the end, along with the rails 37 attached on the upper side, to be deactivated in the position of the heating bar 14*a* represented in FIG. 10.

In the position of the movable heating bar 14*a* represented in FIG. 11, all the heating segments of the heating bars 14*a*, along with the rails 37 attached on the upper side, are activated.

As can be seen from FIGS. 9 to 14, in the case of this illustrated embodiment two clearances 17 are provided in the plate 16 and are respectively adjoined by a channel portion 18, in which a reducing damper 19 and a transporting apparatus 20 formed as a fan are in each case provided.

In the case of the illustrated embodiment represented in FIGS. 9 to 14, only one of the four heating bars 14*a* is movably formed, while the rest of the shrink frame 14 comprising the other three heating bars 14*a* cannot itself be made to move any further and assumes an altogether U-shaped configuration. It goes without saying that embodiments in which two or more heating bars 14*a* are movable are also possible, so that in this way both adaptation to the length and adaptation to the width of the stack of items 1 is possible.

In the case of the illustrated embodiment represented in FIGS. 9, 10 and 14, the stack of items 1 is placed in such a way that the middle of the stack of items 1 coincides approximately with the middle of the right-hand clearance 17. In this case, the distance on opposite sides from the heating bars 14*a* that are respectively adjacent and parallel to the sides is approximately the same. If the stack of items 1 represented in FIGS. 9 and 10 is concerned, the left-hand heating bar 14*a* is then made to move in the direction of the stack of items 1 until the distance corresponds approximately to the distance between the other three heating bars 14*a* and the stack of items 1.

In the position of the heating bar 14*a* represented in FIGS. 9, 10 and 14, the reducing damper 19 of the channel portion 18 represented on the left in FIG. 9 is closed. Consequently, in the later suction-removal phase, the heating gases are only sucked away by means of the transporting apparatus 20 through the right-hand clearance 17, in the direction of the arrows 33.

In the case of stacks of items 1 of greater lengths, as represented in FIGS. 11, 12 and 13, both transporting apparatuses 20 are "active" and, for example, both reducing dampers 19 are open during the suction removal, since both clearances 17 are located within the contour of the stack of items 1. The stack of items 1 is in this case placed in such a way that the middle between the clearances 17 is aligned approximately to coincide with the middle of the upper side of the stack of items 1. The operating situation represented in FIG. 12 for a relatively long stack of items 1 and in FIG. 10 for a relatively short stack of items 1 corresponds approximately to the operating situation represented in FIG. 2.

To prevent tilting of the combined heat diverting and pressing apparatus 5 in the state in which the apparatus is lying against the upper side of the stack of items 1, in particular in the case of stacks of items 1 of relatively small length, an apparatus 41 is provided.

This apparatus 41 is provided in the region of the edge of the plate 16 that laterally protrudes the most with respect to the stack of items in comparison with the other edges of the plate 16.

In the illustrated embodiment represented, the apparatus 41 is formed as a cylinder 42, which acts on a lever arm 43 connected to the plate 16, and so the plate 16 is raised in the region of this edge. Consequently, the plate 16 does not tilt but is held in an approximately horizontal alignment, so that approximately the same force acts on every point of the upper side of the stack of items 1.

If a number of heating bars 14*a* are movable, it is appropriate if an apparatus 41 is provided in the region of every edge of the plate 16 where there is an adjacent movable heating bar 14*a*.

The invention claimed is:

1. A method for shrinking a heat shrink film wrapping placed around a palleted stack of items, using at least one heat shrinking apparatus, which apparatus can be made to move in a vertical direction on a supporting frame, comprising the steps of:

wrapping said palleted stack of items with heat shrink film wrapping so that the heat shrink film wrapping protrudes on an upper side at least beyond an upper edge of the stack of items and forms an upper shrink formation including a top sheet film, which top sheet film is welded to the heat shrink film wrapping, making hot gases rise upwardly along the sides of the stack of items so as to begin shrinking said heat shrink film wrapping and diverting said hot gases in a direction extending at least approximately parallel to the upper side of the stack of items, preheating said top sheet film, and folding over the upper shrink formation of the heat shrink film wrapping onto the upper side of said stack of items and joining layers of said upper shrink formation, at least in the region of the upper side of the stack of items, by pressing said layers of said upper shrink formation now lying one on top of the other and including the heat shrink film wrapping and the top sheet film onto one another using a combined heat diverting and pressing apparatus, thereby completing an upper shrink wrap of said stack of items.

2. The method as claimed in claim 1 wherein, the heat shrinking apparatus is initially made to move upward to carry out the upper shrink wrap and subsequently made to move downward to carry out a lower shrink wrap of a lower shrink wrap formation depending downwardly from said upper shrink wrap formation.

3. The method as claimed in claim 1 wherein, the shrinking begins at approximately half the height of the stack of items.

4. The method as claimed in claim 1 wherein, the upper shrink formation of the heat shrink film wrapping that protrudes on the upper side beyond the upper edge of the stack of items is made to stand up by an air stream generated by the combined heat diverting and pressing apparatus and is directed outward.

5. The method as claimed in claim 1 wherein, the hot gases rising up along the sides of the stack of items and diverted in a direction extending parallel to the upper side of the stack of items are drawn away by the combined heat diverting and pressing apparatus.

6. The method as claimed in claim 1 wherein, the heat shrinking apparatus is made to move vertically downward, pressing said layers lying one on top of the other of the heat shrink film wrapping and the top sheet film onto one another.

7. The method as claimed in claim 1 wherein, when carrying out a lower shrinking wrap of a lower shrink formation, the pressing of the layers lying one on top of the other of the heat shrink film wrapping and the top sheet film onto one another is also carried out.

* * * * *